US006843190B1

(12) United States Patent
LaPierre-McAfee

(10) Patent No.: US 6,843,190 B1
(45) Date of Patent: Jan. 18, 2005

(54) FREE MOTION SEWING METHODS AND MECHANISMS

(76) Inventor: Florence L. LaPierre-McAfee, 14100 Tamiami Trail E, Unit 460, Naples, FL (US) 34114-8434

( * ) Notice: Subject to any disclaimer, the term of this patent is extended or adjusted under 35 U.S.C. 154(b) by 0 days.

(21) Appl. No.: 10/610,431

(22) Filed: Jun. 30, 2003

(51) Int. Cl.[7] ..... D05B 11/00; D05B 97/00; D05B 73/12

(52) U.S. Cl. ..... 112/475.01; 112/260; 112/475.08; 112/117; 112/102

(58) Field of Search ..... 112/475.01, 475.08, 112/475.04, 475.18, 260, 258, 303, 439, 78, 102, 103, 117; 38/102.2; 425/DIG. 55; 384/908, 909

(56) References Cited

U.S. PATENT DOCUMENTS 2,580,101 A * 12/1951 Johnson ..... 112/121
2,652,800 A * 9/1953 Scheiwiller ..... 112/260
3,066,628 A * 12/1962 Morrissey ..... 112/260
4,150,633 A * 4/1979 Adams ..... 112/260
4,357,885 A * 11/1982 Stockton ..... 112/103
4,441,444 A * 4/1984 Jung ..... 112/311

* cited by examiner

*Primary Examiner*—Ismael Izaguirre
(74) *Attorney, Agent, or Firm*—D. D. McGraw

(57) ABSTRACT

A method and mechanism for free form sewing in which the workpiece is being sewn on a sewing machine having a plastic sheet or panel secured to the sewing machine work surface which has a coefficient of friction in any of several ranges which are all considered to be low friction coefficients. Depending upon the plastic material used, the coefficient of friction of any particular material may be in the range of 0.02 to 0.20, or in smaller ranges of coefficients of friction. The objective in using the method or mechanism is to permit the workpiece being sewn by free form sewing to be moved more easily with less frictional resistance by the hands of the sewing machine operator. Various plastics usable include various types of Teflon.

17 Claims, 2 Drawing Sheets

FREE MOTION SEWING METHODS AND MECHANISMS

The invention relates to methods of sewing, and more particularly to improvements in free form sewing, and to mechanisms for practicing those methods. Free form sewing is often used with quilting operations and thread painting, and, when quilting, is typically concerned with a multi-layered workpiece. Essentially, free form sewing is the movement of the workpiece material being sewn by moving that material with the sewing machine operator's hands in relation to the needle and thread of the sewing machine so that the patterns made by the stitching, whether doing quilting or thread painting, is free form in style and design.

BACKGROUND OF THE INVENTION

In free form sewing, the feed teeth that normally advance the material as each stitch is made are not used. All of the movements of the workpiece material are accomplished by the hands of the sewing machine operator. Some sewing machines have the ability to retract the feed teeth so that they do not engage the material being sewn. Others, usually very simple portable or even battery powered sewing machines, do not have retractable feed teeth, and it is more difficult to do free form sewing when they are in place, even if they can be disabled from movement. Even when the feed teeth are retracted or rendered inoperable there are still parts of the sewing machine that do not permit full free form sewing without any of those parts engaging the material being sewn, and the sewing machine operator has to work around them and at times lift up the material being sewn so that there is no engagement of any machine parts in the vicinity of the needle, presser foot and needle plate, which is also a bobbin cover, with the material being sewn.

Prior to the invention herein disclosed and claimed, the workpiece was just moved over the workpiece surface of the sewing machine. This is not practical unless the feed teeth are not only disabled, but are moved below the sewing machine workpiece surface so that they do not engage the workpiece material at any time during the free form sewing operation. Also, the needle plate has openings therein and one or more upper edges thereof may at times not be in perfect planar alignment with the sewing machine work surface, and the work surface itself may have a coefficient of friction which is sufficiently high to cause some resistance to easy sliding movement of the workpiece directly over the sewing machine work surface. Some unheeded deposits may be on that surface and inadvertently provide impediments to smooth workpiece movements, such as residue from various glue-like substances used in sewing at times. Any unneeded resistance to smooth free form movements of the workpiece can adversely affect results of the free form sewing of the workpiece as the sliding force exerted thereon by the operator's hands, causing the final sewn product containing the particular results thereof to be less smooth or free-flowing than desired. Therefore, it is advantageous to provide a smooth low coefficient of friction work surface on the work support sheet or panel which may be easily and inexpensively replaced by the sewing machine operator if it develops any adverse flaws after use or storage or handling, minimizing the problems that may occur with a higher coefficient of friction work surface which is typically provided on the work surface of sewing machines or the likelihood that the feed teeth can be in position to engage some part of the workpiece material, adversely affecting the smooth movements of the workpiece material being sewn as the hands of the sewing machine operator move that workpiece material while free form sewing.

BRIEF SUMMARY OF THE INVENTION

The method embodying the invention employs a thin plastic sheet or panel as a workpiece support material that has a low coefficient of friction (COF), and is preferably flexible yet somewhat stiff. It also employs a sewing machine of the type having a bobbin containing sewing thread, one or more spools containing other sewing thread, a needle mounted in a needle clamp assembly movable to move the needle manually downwardly and upwardly, a presser foot, a work surface, and a workpiece to be sewn. An example of a preferred embodiment of such a polymer sheet or panel is one that is made of Teflon® Polytetrafloroethylene (PTFE) from DuPont. This material has a low COF in the range of 0.03–0.15, depending on the load placed on the sheet or panel, the sliding speed of a particular material surface on and relative to the low COF of the sheet or panel, and the particular Teflon® finish used. This entire range of COF is satisfactory in practicing the method herein disclosed and claimed. Because of the very low loads placed on the workpiece material and therefore on the low COF surface of the sheet or panel engaged by the workpiece material, and slow sliding speeds on the interface between the Teflon® workpiece support sheet or panel and the workpiece, as well as the finish of typical commercially available thin Teflon® sheets and panels, the lower portion of the range of COF, 0.03 to about 0.08 is particularly satisfactory.

Other members of the families of Fluoropolymers, Polyimides and Acetal plastics may be used so long as they meet the workpiece support material requirements set forth above. Nylon is an example of the Polyimide family. Delrin® and Celcon® are examples of the Acetal family. It is well known that different ones of the members of these families have different ranges of COF, as well as other characteristics, and that some of them are provided in forms that do not meet these workpiece support material requirements, while other variations thereof can do so. It is only such variations that are usable in the method embodying the invention. Some may have a slightly higher COF upper range limit than 0.15, at times up to about 0.20 range. While these obviously may have a COF range which makes them less slippery than those in the lower COF range, they can perform adequately so long as the COF of the material used is lower than the COF of the standard work surfaces of sewing machines. Most of these materials can be checked out on web pages of DuPont, and the choice of the particular material is usually one that is relatively inexpensive, and has a sufficiently low COF to be able to slide the cloth workpiece around on the surface in the manner of free motion sewing. Thus, the preferred range of the COF of the material being used is from 0.02 to about 0.08, with a satisfactory COF range extending upwardly to about 0.20.

There is a distinction made between the static COF (at the point of incipient motion) and the dynamic or kinetic COF (measured at constant velocity). The difference between the static COF and the dynamic or kinetic COF is known as "slip-stick" and the numerical difference is the slip-stick value. Static friction is greater than dynamic or kinetic friction, and therefore the coefficients of friction for these two conditions are usually of different values. By way of example, with steel on steel, the static COF is 0.74 and the kinetic COF is 0.57; aluminum on steel, the static COF is 0.61 and the kinetic COF is 0.47; rubber on concrete, the static COF is 1.0 and the kinetic COF is 0.8; lubricated metal on metal, the static COF is 0.15 and the kinetic COF is 0.06; ice on ice, the static COF is 0.1 and the kinetic COF is 0.03; and Teflon®on Teflon® in both static and kinetic COF is 0.04.

Polymers such as Teflon® with a low (even 0.0) slip-stick value are industrially used for parts which undergo back-and-forth or stop-and-go movements. Typical industrial uses are under relatively much heavier loads and more stringent stop-and-go movements than are used in practicing the methods herein disclosed and claimed. The very light loads placed on the polymer sheet or panel used, being only that the weight of the workpiece material itself, which is usually very light, and the loads impressed by an operator's hands on the workpiece material. These hand-applied loads or forces are only sufficient to easily move the workpiece around on the polymer sheet or panel while the sewing machine is sewing free form stitches, render the slip-stick value of the particular polymer in relation to the typical cloth sewing materials substantially unnoticeable, even if it exists at all, to the sewing machine operator, and therefore the range of the COF, whether static or dynamic (kinetic) under such light loading and stop-and-go movements, is about the same under either type of COF. Therefore, other polymers having a similar range of COF to that of Teflon® may be used, so long as they are available in relatively thin flexible sheets or panels and are capable of being pierced by a sewing needle or a die punch and thereafter allowing the sewing needle to move into and out of the hole if such a sheet or panel formed by that piercing, as occurs during a sewing operation employing the polymer sheet or panel.

The polymer sheet or panel used in the development and reduction to practice of the invention herein disclosed and claimed has been easily rolled up onto a tube form for temporary storage, or just stored in a file folder, by way of example, without any substantial bending or rolling thereof. Also, it has been able to lie over unretracted feed teeth of a sewing machine and be sufficiently flexible to have most of its lower surface remain in contact with the work surface of the sewing machine as the sewing machine operator moves a free form sewing workpiece around while sewing on it. These characteristics are desirable in all plastic sheets or panels when practicing the invention herein disclosed and claimed.

One method embodying the invention employs the steps of: (1) placing a suitable plastic sheet or panel of workpiece support material so that it is under the sewing needle when the presser foot and the needle are positioned in their upward positions; (2) manually moving the presser foot down into engagement with the workpiece support material, holding the workpiece support material in place under the needle; (3) manually moving the needle downwardly until it has pierced through the workpiece support material and, at or near the bottom part of its sewing stroke, forming a hole therein; (4) anchoring the corners or outer edges of the workpiece support material to the flat plate of the sewing machine by use of suitable removable anchoring means such as Scotch® Tape or similar tape; (5) removing the needle upwardly out of the pierced opening in the workpiece support material; (6) placing a workpiece to be sewn by free form sewing under the needle so that it can be sewn, with the workpiece lying on the workpiece support material; and (7) operating the sewing machine to sew the workpiece in a desirable free form pattern or thread painting process, moving the workpiece by sliding it around by hand on the low coefficient-of-friction upper surface of the workpiece support material.

A modification of the method aspect of the invention herein described and claimed involves the above-numbered steps (3) and (5), in which the sewing needle may be moved downwardly to mark the position of an opening which is then formed by other means such as drilling or die punching the opening through the workpiece support material as a separate step taking place with that material having been removed from the sewing machine to perform that drilling or punching step, after which the material may serve as a pattern to make other such plastic sheets or panels having the same opening location therethrough and adapted to be used on other sewing machines on which the additionally made workpiece support materials are respectively secured with each such opening being in alignment with the sewing needle of each such other sewing machine. At times, the position of the drilled or punched opening on the plastic sheet or panel may be calculated and the opening created without requiring the needle to mark on a particular plastic sheet or panel the point where the drilling or punching to make the opening. Different patterns or measurements for the location of an opening for different other sewing machines may be made or calculated as needed, and other workpiece support materials may have openings formed therethrough to match such other sewing machines. At times, it is within the purview of the invention for one workpiece support material to have two or more such openings, each one being located to be used with a specific different machine layouts.

The mechanism embodying the invention includes the work support material, also known as the work surface slider, having a low COF in the order of about 0.03 to 0.20, with a preferred range in the order of 0.03 to about 0.08, although the higher end 0.20 of the COF range noted will work sufficiently well to be advantageous to some extent. It also includes an opening properly positioned on and through the plastic sheet or panel forming the work surface slider to allow the sewing needle and the strand of sewing thread from the bobbin to pass therethrough during the sewing operation, such opening being located by any of the several procedures set forth above and formed by any known methods of locating and forming an opening through such a plastic sheet or panel.

DETAILED DESCRIPTION OF THE INVENTION

Figure 1:
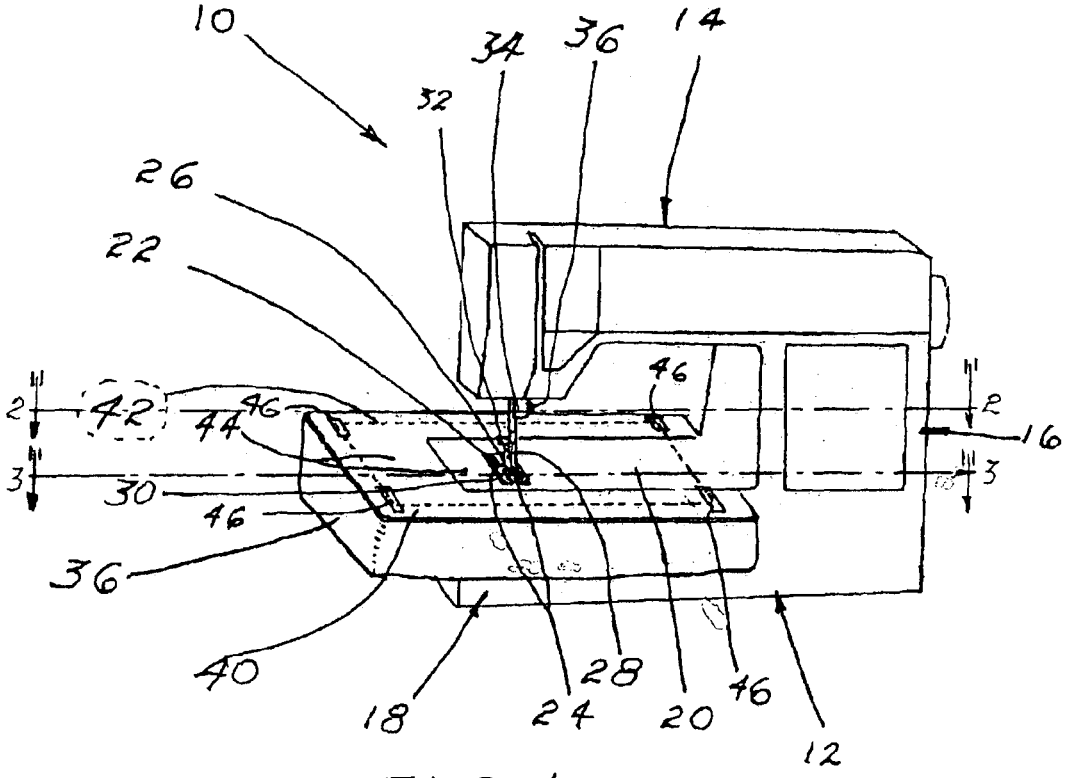
FIG. 1 is a perspective view of a typical sewing machine, shown in simplified form, with the low COF sheet or panel constituting the work surface slider being shown in place with dashed lines.
Figure 4:
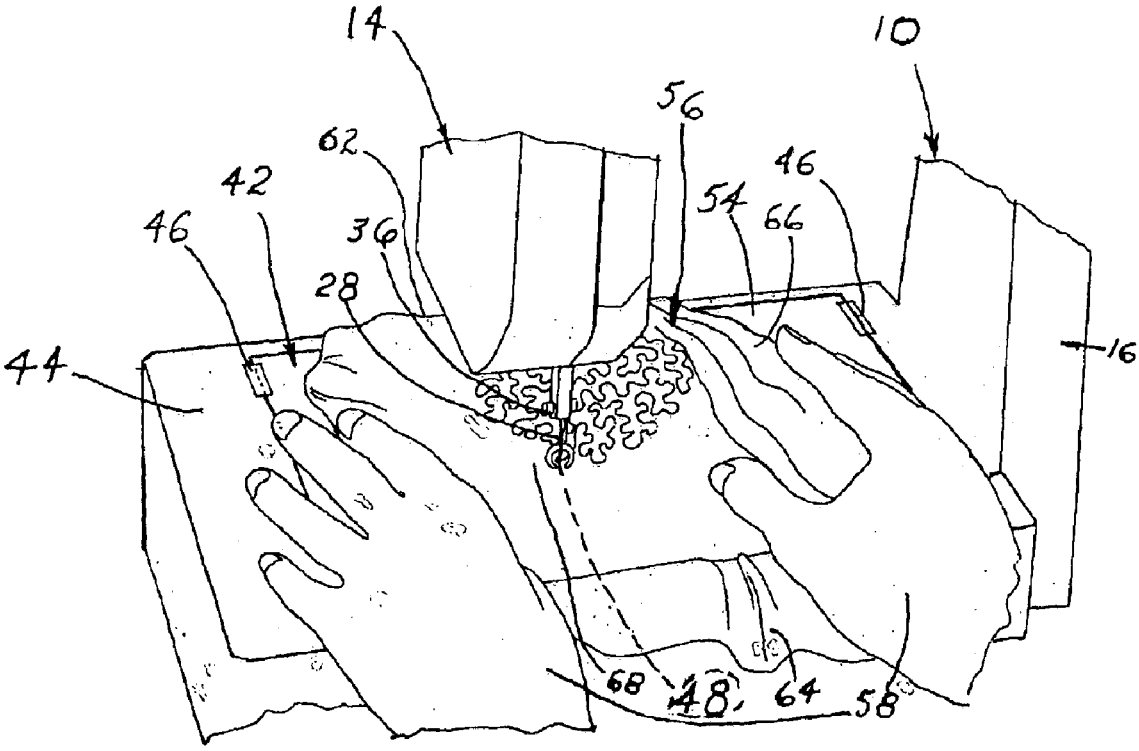
FIG. 4 is a view similar to FIG. 1, showing the workpiece material on top of the workpiece support and slider material, and the hands of a sewing machine operator engaging the workpiece material and having moved that material around on the workpiece support and slider material to create a design being sewn in free form.

The sewing machine 10 of FIGS. 1 and 4 is intended to generically represent any electric sewing machine which has been, is, or later shall be on the market, whether it is one of the high end, digitally programmed and controlled types, one of the lower end ones where relatively few if any options as to stitches and patterns, etc., are available, to the low end sewing machines such as portable ones which only sew with one type of stitch, yet are adequate for very simple sewing, and may be powered by one or more batteries, or even by a hand crank. One basic characteristic of all such machines is that they have a work surface, a needle for sewing using a thread supply, and a presser foot, and are capable of manual movement of the needle sufficient to punch a hole in the workpiece support material, or to mark the position through which an opening is to be separately formed, if that position is not otherwise determined, as will be described.

The drawing of the particular sewing machine 10 shown in FIG. 1 is a simplified drawing of the more upscale type such as a Husqvarna® Viking Series I® sewing machine, that particular sewing machine being used only for illustrative purposes. The invention is not limited td use only with that type of machine, but is usable with any sewing machine which may be operated as described. The sewing machine 10 has a housing providing a base 12, a head 14 and a head support 16 so that a portion of the base 12 is a free arm 18 extending underneath the head 14. The upper surface of the free arm 18 provides a work surface 20 having a needle plate 22 covering the bobbin area. A pair of parallel-positioned feed teeth 24 extend upwardly through the needle plate and are in position to move a workpiece material during normal sewing operations. When it is desired, feed teeth 24 may be moved downwardly from the position in which they may engage the workpiece material when desired to a position where they are below the surface of the needle plate. There is also a needle opening 26 in the needle plate 22, through which a sewing needle 28 may be moved in a reciprocal manner during the sewing process to have a needle thread, not shown, pick up a thread, not shown, from a bobbin located under the needle plate 22 each time a stitch is sewn, as is well known in the art of sewing machines. A presser foot 30 is mounted on a presser foot bar and ankle 32 and the needle 28 extends through the presser bar and ankle 32. Presser foot 30 may be moved toward and away from the needle plate 22 in vertical directions to selectively engage a workpiece material while sewing and to release the workpiece material from its being-sewn position when it is desired to move or remove or replace the workpiece material from under the needle 28 and the presser foot 30. Needle 28 is secured to the needle bar 34 by a needle clamp screw 36. The needle bar 34 is connected to a mechanism in the head 14 so that it is driven in a reciprocal manner as the stitches are sewn, moving the needle into and out of the needle opening 26 during each sewing stitch operation. The sewing machine 10 also includes a generally U-shaped accessory tray 38 which fits on and about the free arm 18. Tray 38 has a top surface forming a work surface extension 40 which is in coplanar relation with the work surface 20 of the free arm 18, thus providing a larger total work surface which directly supports the workpiece material being sewn during normal sewing operations.

Figure 2:
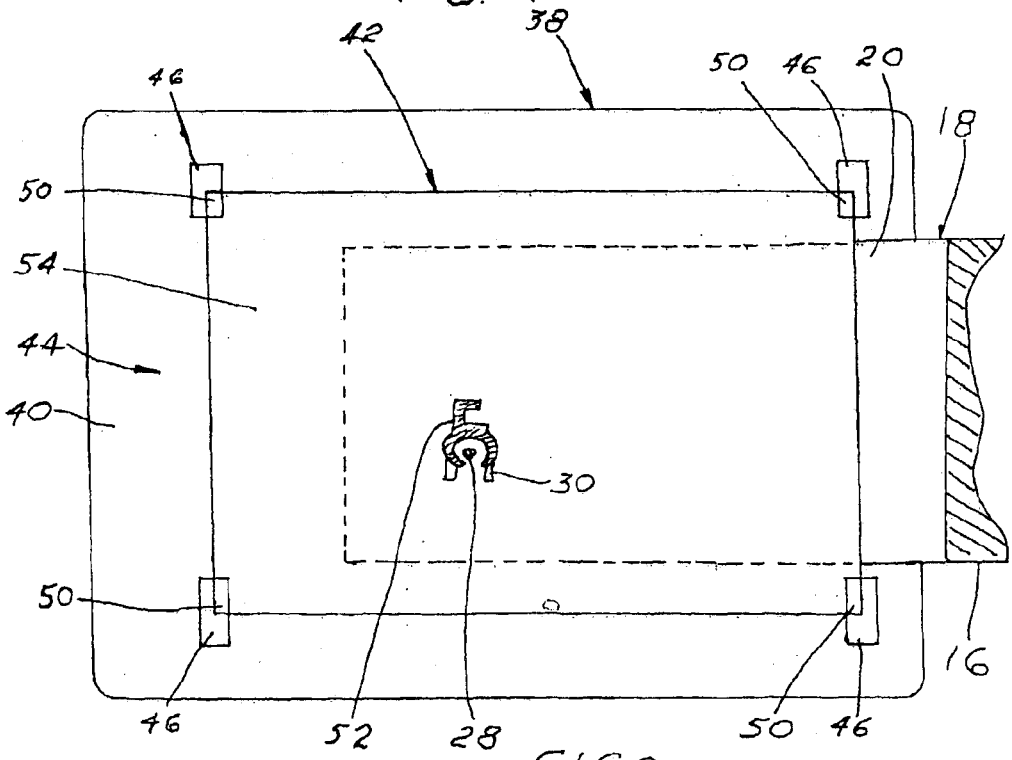
FIG. 2 is a view taken in the direction of arrows 2—2 of FIG. 1, with parts broken away and a part of the needle and presser foot ankle mount being in cross-section.
Figure 3:
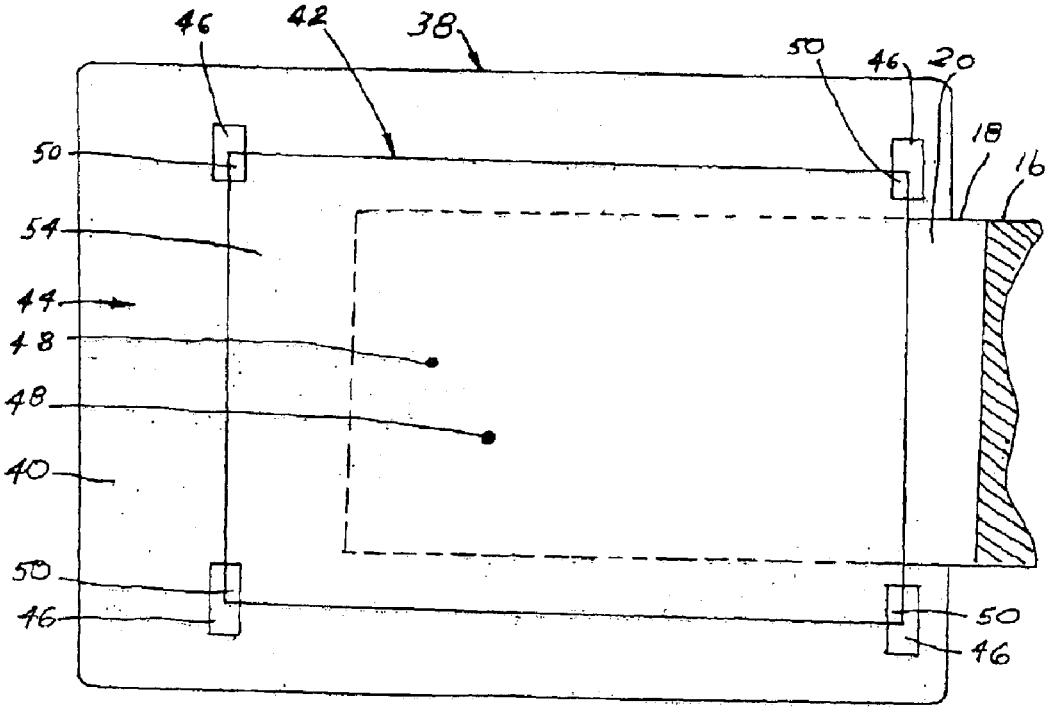
FIG. 3 is a view similar to FIG. 2, but with the plane of view being below the lower end of the needle and the bottom of the pressure foot so that only the opening in the workpiece support and slider material made by the needle is visible, with the sewing needle extending through that opening and the presser foot engaging the upper surface of the work surface slider.

FIG. 1 also shows, in dashed lines, the position of the work surface slider 42 shown in full view in FIGS. 2, 3 and 4. Work surface slider 42 is a sheet or panel of an appropriate plastic material have a low COF as above described. It is illustrated as being a rectangular sheet having a total area and dimensions so that it fits over the extended work surface area 44 formed by work surface 20 and work surface extension 40, but is preferably slightly smaller than that extended work surface area in all directions. Of course, it may have shapes other than rectangular and for this reason it is also referred to as a panel. FIG. 1 also shows several fastening tapes 46 which are used to fasten the work surface slider in position as will be described below with regard to FIGS. 2, 3 and 4.

FIG. 2 shows the work surface 20, which is the upper surface of the free arm 18, and a cross section of a part of the head support portion 16 of the sewing machine housing. It also shows the work surface extension 40 of the accessory tray 38. The work surface 20 and the work surface extension 40 combine to form the sewing machine's extended work surface area 44. It also shows the work surface slider 42 in position over a portion of the extended work surface area 44, with the sewing needle 28 extending through the opening 48 which has been formed with the work surface slider 42 in the position shown and secured in that position by the tapes 46. Since the work surface slider 42 is shown in the shape of a rectangle, there is a tape 46 securing each of the four corners 50 of it to the extended work surface area 44. Of course, the work surface slider may have other planar shapes as may be desired so long as the intent of the invention is capable of being carried out, and the tape locations are then located accordingly to secure the work surface slider 42 in the desired position. It is advantageous but not necessary to use the removable type of tapes, which have sufficient retention power but can be removed easily when desired. These tapes are preferably thin, self-sticking tape sections such as 3M's Scotch® tape. They adhere to the work surface slider corners 50 and also to portions of the extended work surface 44, holding the work surface slider 42 in position so that, when the sewing needle 28 is retracted upwardly out of the opening 48, the sewing needle and that opening remain in axial alignment so that the sewing needle 28, when moved downwardly in each stitch operation, freely reenters the opening 48, shown in FIG. 3 but not shown in FIG. 2 and located directly under the sewing needle 28, and does not pierce through the work surface slider 42 at another point and create more, unneeded, openings through it so long as the work surface slider is being used on one sewing machine. The maintenance of this alignment of the sewing needle 28 and the opening 48 during the entire free form sewing operation is therefore important.

FIG. 3 is similar to FIG. 2, but shows, in section, the sewing needle 28 and the presser foot ankle mount 52, which are in position so that the presser foot 30 is in engagement with the work surface slider 42 while the sewing needle 28 is extended through the opening 48 and the needle plate opening 22, having pierced through the work surface slider 42 to form opening 48. Once the work surface slider 42 is secured to the extended work surface 44 and the opening 48 has been formed, the sewing needle 28 and the presser foot 30 are retracted upwardly. The upper surface 54 of the work surface slider provides a surface for supporting the workpiece material to be sewn. FIG. 3 also shows a variation of the invention wherein another opening 48', similar to opening 48, is provided so as to be located properly for use with a different make or model of sewing machine where the sewing needle is differently located relative to the machine's work surface 44. This makes one such work surface slider 42 more versatile by having it prepared to work with another sewing machine. At times even more such openings may be provided to prepare one work surface slider 42 to work with still other makes and models of sewing machines.

A workpiece material 56, illustrated in FIG. 4, is then inserted under the sewing needle 28 and the presser foot 30, located where the sewing machine operator wants to begin free form sewing, and the presser foot is lowered to engage the upper surface of the workpiece material 56. This workpiece 56 may be a single layer or several layers of material.

When it is to be a part of a quilt, it typically has a lower layer and an upper layer, with batting or other filler material between those layers. The under side of the workpiece material is in slidable engagement with the low COF work support surface 54. When the sewing operation begins, these layers and the filler material are sewn together, and the pattern made by the sewing is formed on the material layers in free form creation by the operator placing his/her hands 58 on the workpiece material on either side of the sewing needle 28 and the presser foot 30, and freely moving the workpiece material around relative to the sewing needle by sliding its lower surface on the low COF work support surface 54 provided by the work surface slider 42. This low COF characteristic of the work support surface 54 allows virtually free, no-sliding-resistance movements of the workpiece material, allowing the machine operator to free form the exact stitch design desired on the workpiece material with no significant drag.

This sewing operation is illustrated in FIG. 4, which is similar to FIG. 1. The work surface slider 42 is shown as having been fastened by tapes 46, located at or near its corners 50, to the extended work surface area 44 of the sewing machine 10, after having had the opening 48 formed therethrough by one of the methods described and claimed. The workpiece material 56 has been placed on top of the upper surface 54 of the work surface slider 42, and the sewing machine operator, whose hands 58 are shown, has done some free form sewing, illustrated as the pattern 60 sewn on the workpiece material 56. As is common in sewing, the workpiece material 56 is larger than the sewing machine extended surface 44, and some part 62 of it extends over the back side of the accessory tray 38 which forms a part of surface 44, some other part 64 of it extends over the front side of that tray and in front of the sewing machine operator. If its width is greater than the length of surface 44, it is commonly gathered together as shown at 66. The portion 68 in the immediate vicinity of where the sewing operation takes place is held tight and flat by the hands 58 of the sewing machine operator.

When the feed teeth 24 are not retracted, or are not even retractable, the work surface slider 42 covers them and is sufficiently flexible to engage the major portion of the typically higher COF extended work surface 44 so that the feed teeth do not interfere with the smooth sliding operation of the workpiece material on the low COF surface 54 as the free form sewing process is carried out. The work surface slider 42 is sufficiently strong that the feed teeth, if they engage the bottom surface of slider 42, do not damage it so as to cause any crack therein which would interfere with the free sliding action of the workpiece material on the work support surface 54.

A work surface slider 42 has been made from Teflon® sheet material having a thickness of 0.010 inch, such as is commercially available from Interplastic Inc. of Burlington, N.J. It is specifically identified by that source as "virgin PTFE film," is available in sheet rolls of 12" in width and various thicknesses, including 0.005, 0.010 and 0.015 inch and thicker. This is an appropriate width of the plastic stock from which the work surface slider 42 is to be made because of the dimensions of the typical sewing machine work surface 44, and any particularly desired size sheet or panel may be cut from the roll. The 0.005 inch thickness, while having been tried and found to be usable, is relatively flimsy and not as easy to manage as a somewhat higher thickness. Therefore, it is not as desirable as a somewhat thicker sheet. Furthermore, it is to be understood that, while it is preferable to use a single layer for the flexible sheet or panel, it may be made in two or more layers, it only being required as a minimum that one outside layer thereof be made of a plastic material having its COF within the desired range. The 0.005 inch thick Teflon®PTFE material noted above could serve as the top or uppermost layer of such a multiple-layer slider 42. Of course, a single layer sheet of the appropriate plastic material is usually desired because it is usually considerably less expensive that making a multi-layered sheet or panel, and may have the COF of both of its sides within the desired range, often permitting each of the two sides of the slider 42 to be used at various times.

As the Teflon® sheet or panel to be used as a work surface slider 42 is increased in thickness, its flexibility decreases. When its flexibility is decreased it reaches a point where it is not sufficiently useful in practicing the invention because it is then too thick to flex so as to be supported by and in engagement with most of the work surface 44 immediately under it. Thus there are practical limits to the sheet or panel thickness because of this lack of flexibility or its being overly flexible. As the sheet or panel 42 is decreased in thickness, it reaches a point that, while still usable in a single thickness, it is not preferred because it is too flimsy for easy manipulation and use. Thus, the desirable range of thickness is 0.010 to about 0.030 inch, the actual limit of such upper measurement of its thickness is to be understood to be that beyond which the material is not sufficiently flexible as above required. With different materials, these thickness ranges may be different. A particular thickness of a particular material to be used in any particular application is readily determined by simple trial using sheets of several thicknesses and selecting the one with the characteristic that best fits the purpose when practicing the invention.

What is claimed is:

1. A method of free form sewing comprising the steps of:

(a) providing a sewing machine having a manually driveable and motor driveable sewing needle, a presser foot, and a work surface for operatively supporting a workpiece material to be sewn and sewing thread;

(b) and further providing a plastic sheet or panel to serve as a workpiece support and a work surface slider for the workpiece material to be sewn and having at least an upper surface having a low coefficient of friction within the range of 0.02 and higher;

(c) providing an opening through the plastic sheet or panel which is axially alignable with the sewing needle and is of a size that will permit the sewing needle to reciprocally move into and out of that opening during the free form sewing operation;

(d) placing the plastic sheet or panel under the sewing needle and the presser foot while the sewing needle and the presser foot are in their upward positions so as to cover a portion of the sewing machine work surface with the plastic sheet or panel;

(e) manually moving the presser foot downwardly into position-holding engagement with the upper surface of the plastic sheet or panel;

(f) securing the plastic sheet or panel to the sewing machine work surface and in doing so preventing the plastic sheet or panel from moving relative to the surface of the sewing machine which it covers;

(g) manually moving the sewing needle downwardly and determining that the sewing needle can and does move freely into and out of that opening through the plastic sheet or panel through which the sewing needle then extends;

(h) removing the sewing needle out of the opening in the plastic sheet or panel while retaining the sewing needle in alignment with that opening, and retracting the presser foot away from the upper surface of the plastic sheet or panel;

(i) placing a workpiece to be sewn by free form sewing under the needle and the presser foot with the workpiece being supported by the low coefficient upper surface of the plastic sheet or panel;

(j) and operating the sewing machine to sew the workpiece in any desirable free form pattern or thread painting, moving the workpiece on the upper surface of the plastic sheet or panel by hand.

2. A modified method of free form sewing as set forth in claim 1, wherein steps (c) through (h) are performed by the steps of:

(c') placing the plastic sheet or panel under the sewing needle and the presser foot while the sewing needle and the presser foot are in their upward positions so as to cover a portion of the sewing machine work surface with the plastic sheet or panel;

(d') manually moving the presser foot downwardly into position-holding engagement with the upper surface of the plastic sheet or panel;

(e') securing the plastic sheet or panel to the sewing machine work surface and in doing so preventing the plastic sheet or panel from moving relative to the surface of the sewing machine which it covers;

(f') manually moving the sewing needle downwardly, piercing an opening through the plastic sheet or panel through which the sewing needle then extends; and (g') removing the sewing needle out of the pierced opening in the plastic sheet or panel while retaining the sewing needle in alignment with that pierced opening, and retracting the presser foot away from the upper surface of the plastic sheet or panel;

and then performing steps (i) and (j) of claim 1.

3. The method of claim 2 in which said range of the coefficient of friction in step (a) is from 0.02 to 0.20 and the thickness of the workpiece support material is within a thickness range from 0.010 inch to 0.030 inch.

4. The method of claim 2 in which said range of the coefficient of friction in step (a) is from 0.02 to 0.15.

5. The method of claim 2 in which said range of the coefficient of friction set forth in step (a) is 0.04 to 0.10.

6. The method of claim 2 in which the plastic sheet or panel is made of a polymer.

7. The method of claim 2 in which the plastic sheet or panel is chosen from a group of plastic having a coefficient of friction range from about 0.04 to 0.15 and Teflon®FEP having a coefficient of friction range from 0.12 to 0.20.

8. The method of claim 2 is which the upper surface of the plastic sheet or panel which supports the workpiece has a range of its coefficient from 0.05 to 0.20.

9. The method of claim 2 in which the plastic sheet or panel is upper surface which supports the workpiece having a coefficient of friction between 0.04 and 0.15.

10. For use with a sewing machine comprising a work support surface, a sewing needle, a presser foot and means for manually operating said sewing needle and said presser foot and power means for operating said sewing needle in sewing operation:

the mechanism for substantially friction-free free form sewing of a workpiece, said mechanism comprising a flexible plastic sheet material having at least one surface which has a coefficient of friction within a range of 0.04 to 0.15, means for securing said flexible plastic sheet material to said sewing machine work support surface so that said surface of said flexible plastic sheet material having said range of coefficient of friction becomes a work support surface for a workpiece to be sewed by free form sewing, said flexible plastic sheet material having an opening therethrough, said opening having been formed so as to be positioned in axial alignment with said sewing needle when said flexible plastic sheet material is secured to said sewing machine work support surface and alternately reciprocally receiving said sewing needle therethrough and having said sewing needle removed therefrom during each stitch cycle of the sewing machine sewing operations, said workpiece when being supported by said flexible plastic sheet material during sewing operations being in substantially free slidable relation with said flexible plastic sheet material, said one side of said flexible plastic sheet material having a coefficient of friction within the range of 0.02 and 0.20 and being made of a plastic chosen from a group of plastics including fluoropolymers, polyimides and acetal.

11. The mechanism of claim 10 wherein there is at least one more opening having been similarly formed through said flexible plastic sheet material to accommodate its use with a different sewing machine having a different location required for receiving said sewing needle therethrough.

12. A method of free form sewing comprising the steps of:

(a) providing a sewing machine having a manually driveable and motor driveable sewing needle, a presser foot, and a work surface for operatively supporting a workpiece material to be sewn and sewing thread;

(b) further providing a plastic sheet or panel to serve as a workpiece support and a work surface slider for the workpiece material to be sewn and having at least an upper surface having a low coefficient of friction within the range of 0.02 up to and including about 0.2;

(c) placing the plastic sheet or panel under the sewing needle and the presser foot while the sewing needle and the presser foot are in their upward positions so as to cover a portion of the sewing machine work surface with the plastic sheet or panel, and securing the plastic sheet or panel to the sewing machine work surface;

(d) manually moving the presser foot downwardly into position-holding engagement with the upper surface of the plastic sheet or panel to at least assist in holding the plastic sheet or panel in position on the sewing machine work surface;

(e) manually moving the sewing needle downwardly to engage the plastic sheet or panel and mark the position thereon of an opening to be formed through the plastic sheet or panel through which the sewing needle will then extend, and thereafter forming such opening through that plastic sheet or panel and through additional such plastic sheets or panels having coefficients of friction within said range of coefficients of friction while using the earlier plastic sheet or panel so marked and having the opening formed therethrough as a pattern, each of such formed openings being so located in the plastic sheets or panels so that the opening formed in each plastic sheet or panel is to be able to be positioned in axial alignment with the sewing needle of a sewing machine;

(f) securing one of the plastic sheets or panels having an opening formed therein in accordance with step (e) above to the work surface of any similar sewing machine capable of utilizing that one plastic sheet or panel with that opening formed therein, with the opening formed therein being positioned in axial alignment with the sewing needle so as to prevent that one plastic sheet or panel from moving relative to the surface of the sewing machine work surface which it covers and therefore retain such axial alignment;

(g) placing a workpiece to be sewn by free form sewing under the needle and the presser foot with the workpiece being supported by the low coefficient upper surface of that one plastic sheet or panel;

(h) and operating the sewing machine to sew the workpiece in any desirable free form pattern or thread painting, freely moving the workpiece on the upper surface of that one plastic sheet or panel by hand with the sewing needle extending through the opening aligned therewith and being retracted out of that opening during each stitch action of the sewing operation.

13. The method of claim 12 in which said range of the coefficient of friction in step (b) is from 0.02 to 0.20.

14. The method of claim 12 in which said range of the coefficient of friction in step (b) is from 0.02 to 0.15.

15. The method of claim 12 in which said range of the coefficient of friction set forth in step (b) is 0.04 to 0.10.

16. The method of claim 12 in which each of the plastic sheets or panels is chosen from a group of plastic having a coefficient of friction range from about 0.04 to 0.15 and having a coefficient of friction range from 0.12 to 0.20.

17. The method of claim 12 in which the upper surface of each one of the plastic sheets or panels which supports a workpiece has a range of its coefficient from 0.05 to 0.20.

* * * * *